US011744356B2

(12) United States Patent
Mehra et al.

(10) Patent No.: US 11,744,356 B2
(45) Date of Patent: Sep. 5, 2023

(54) TOOTHBRUSH WITH DETACHABLE HEAD PORTION

(71) Applicant: HAYDEN PRODUCTS LLC, New York, NY (US)

(72) Inventors: Curan Mehra, New York, NY (US); Alan Trojanowski, New York, NY (US)

(73) Assignee: HAYDEN PRODUCTS LLC, New York, NY (US)

( * ) Notice: Subject to any disclaimer, the term of this patent is extended or adjusted under 35 U.S.C. 154(b) by 148 days.

(21) Appl. No.: 17/552,070

(22) Filed: Dec. 15, 2021

(65) Prior Publication Data

US 2023/0180922 A1 Jun. 15, 2023

(51) Int. Cl.
*A46B 7/04* (2006.01)
*A46B 9/04* (2006.01)

(52) U.S. Cl.
CPC ..... *A46B 7/042* (2013.01); *A46B 9/04* (2013.01); *A46B 2200/1066* (2013.01)

(58) Field of Classification Search
None
See application file for complete search history.

(56) References Cited

U.S. PATENT DOCUMENTS 3,271,805 A 9/1966 Sawyer
3,994,039 A * 11/1976 Hadary ..... A46B 7/02 15/167.1
5,058,233 A 10/1991 Davis, III
5,253,948 A * 10/1993 Butler ..... B25G 3/28 403/348
5,875,510 A 3/1999 Lamond et al.
6,067,684 A 5/2000 Kweon
6,145,152 A * 11/2000 Ward ..... A46B 15/0069 15/176.1
6,237,183 B1 5/2001 Fischer
6,709,185 B2 * 3/2004 Lefevre ..... A46B 5/0095 403/322.3
7,137,166 B1 11/2006 Kraemer
9,770,090 B2 * 9/2017 Chen ..... A46B 7/044
2010/0095973 A1 * 4/2010 Shrier ..... A46B 7/042 15/160
2012/0272469 A1 11/2012 Kwon et al.

FOREIGN PATENT DOCUMENTS

| | | |
|---|---|---|
| CN | 2516021 | 10/2002 |
| CN | 201274866 | 7/2009 |
| CN | 103783804 | 5/2014 |
| CN | 106213767 | 12/2016 |
| GB | 1265270 | 3/1972 |
| JP | 2005270567 | 10/2005 |
| JP | 2017170103 | 9/2017 |
| WO | 2006101286 | 9/2006 |

* cited by examiner

*Primary Examiner* — Brian D Keller
*Assistant Examiner* — Dana Lee Poon

(57) ABSTRACT

A toothbrush having a detachable head portion is provided. The toothbrush includes a handle portion, a neck portion, and a head portion, and the head portion includes a first head portion and second head portion. The second head portion is detachable from the first head portion. The toothbrush further includes a button portion and an attachment/release mechanism. The button portion is actuatable to actuate the attachment/release mechanism to facilitate detachment of the second head portion from the first head portion.

20 Claims, 9 Drawing Sheets

TOOTHBRUSH WITH DETACHABLE HEAD PORTION

FIELD

The present technology is generally related to a toothbrush with a detachable head portion.

BACKGROUND

Effective toothbrushing involves the removal of debris, plaque, and discoloration from teeth and gums without causing damage. The cleaning surface of conventional toothbrushes are generally comprised of tufts of bristles/filaments, which transfer force through the ends to the teeth and gums to dislodge or break up debris and plaque. Cleaning structures such as bristles/filaments of toothbrushes decrease in effectiveness after continued use. That is, the continued use of the cleaning structures results in wear, and the effectiveness of the cleaning structures decreases with such wear. The cleaning structures have a limited life span, and every episode of toothbrushing naturally decreases the life span of the cleaning structures. Inefficiencies can thus be created by using the cleaning structures that have exceeded their effective life span.

Toothbrushes according to the present invention overcome this by incorporating a detachable head portion. The detachable head portion is replaceable with a replacement detachable head portion to facilitate replacement of cleaning structures that have exceeded their effective life span.

SUMMARY

The techniques of this invention generally relate to a toothbrush employing a detachable head portion.

In one embodiment, the present invention includes a toothbrush including a first end, an opposite second end, a mid-longitudinal axis extending through the first end and the second end, a handle portion, a head portion, an internal cavity extending through portions of at least the handle portion and the head portion, a button portion, and an attachment/release mechanism; the handle portion extending from adjacent the first end to a first position intermediate the first end and the second end, the handle portion including an opening adjacent the first end for providing access to the internal cavity; the head portion extending from a second position intermediate the first end and the second end to the second end, the head portion including a first head portion and a second head portion being attachable to one another, the first head portion being integrally formed with the handle portion, and the second head portion being removable from the first head portion, the internal cavity extending through the first head portion, the first head portion including at least one first aperture and a second aperture formed therein, the second head portion including at least one first recess formed therein and a post formed thereon; the button portion being partially received through the opening and in the internal cavity, the button portion being moveable inwardly and outwardly with respect to the opening and the internal cavity; and the attachment/release mechanism including a connecting rod, at least one locking element, and a spring-loaded actuator, the connecting rod being received in the internal cavity, and extending along the mid-longitudinal axis of the toothbrush, and including a first end and an opposite second end, the first end of the connecting rod being operatively connected to the button portion, a locking block being provided at and adjacent the second end of the connecting rod, the connecting rod and the locking block being moveable between a first position and a second position via actuation of the button portion, the at least one locking element being at least partially received in the internal cavity, the at least one locking element being moveable inwardly and outwardly relative to the mid-longitudinal axis of the toothbrush via engagement of the locking block during movement thereof between the first position and the second position, the spring-loaded actuator being received in the internal cavity, and including a first end and an opposite second end, the first end of the spring-loaded actuator being operatively connected to the locking block, and the second end of the spring-loaded actuator being engageable to the post of the second head portion, the spring-loaded actuator being actuatable via movement of the connecting rod and the locking block between the first position and the second position; where, when the first head portion and the second head portion are attached to one another, and when the connecting rod and the locking block are in the first position, the post of the second head portion is received through the second aperture of the first head portion, and the at least one locking element is forced outwardly and received through the at least one first aperture in the first head portion and into the at least one recess in the second head portion via engagement of the locking block with the at least one locking element; and where, when the button portion is actuated, and the connecting rod and the locking block are correspondingly moved from the first position to the second position, the spring-loaded actuator pushes against the post, and the at least one locking element is retracted inwardly relative to the mid-longitudinal axis from the at least one recess in the second head portion to facilitate detachment of the second head portion from the first head portion.

In another embodiment, the present invention includes a toothbrush including a first end, an opposite second end, a mid-longitudinal axis extending through the first end and the second end, a handle portion, a head portion, an internal cavity extending through portions of at least the handle portion and the head portion, a button portion, and an attachment/release mechanism; the handle portion extending from adjacent the first end to a first position intermediate the first end and the second end, the handle portion including an opening adjacent the first end for providing access to the internal cavity, and at least one shoulder in the internal cavity; the head portion extending from a second position intermediate the first end and the second end to the second end, the head portion including a first head portion and a second head portion being attachable to one another, the first head portion being integrally formed with the handle portion, and the second head portion being removable from the first head portion, the internal cavity extending through the first head portion, the first head portion including at least one first aperture and a second aperture formed therein, the second head portion including at least one first recess formed therein and a post formed thereon; the button portion being partially received through the opening and in the internal cavity, the button portion being moveable inwardly and outwardly with respect to the opening and the internal cavity; and the attachment/release mechanism including a connecting rod, a latch, at least one locking element, and a spring-loaded actuator, the connecting rod and the latch being unitarily formed with one another, the connecting rod and the latch being received in the internal cavity, the connecting rod extending along the mid-longitudinal axis of the toothbrush, and including a first end and an opposite second end, the latch being positioned between the first end and the second end of the connecting rod, the first end of the connecting rod being operatively connected to the button portion, a locking block being provided at and adjacent the second end of the connecting rod, the connecting rod and the locking block being moveable between a first position and a second position via actuation of the button portion, the at least one locking element being at least partially received in the internal cavity, the at least one locking element being moveable inwardly and outwardly relative to the mid-longitudinal axis of the toothbrush via engagement with the locking block during movement thereof between the first position and the second position, the spring-loaded actuator being received in the internal cavity, and including a first end and an opposite second end, the first end of the spring-loaded actuator being operatively connected to the locking block, and the second end of the spring-loaded actuator being engageable to the post of the second head portion, the spring-loaded actuator being actuatable via movement of the connecting rod and the locking block between the first position and the second position; where, when the first head portion and the second head portion are attached to one another, and when the connecting rod and the locking block are in the first position, the post of the second head portion is received through the second aperture of the first head portion, and the at least one locking element is forced outwardly and received through the at least one first aperture in the first head portion and into the at least one recess in the second head portion via engagement of the locking block with the at least one locking element; and where, when the button portion is actuated, and the connecting rod and the locking block are correspondingly moved from the first position to the second position, the spring-loaded actuator pushes against the post, the at least one locking element is retracted inwardly relative to the mid-longitudinal axis from the at least one recess in the second head portion to facilitate detachment of the second head portion from the first head portion, and the latch engages the at least one shoulder to hold the connecting rod in the second position.

In yet another embodiment, the present invention includes a toothbrush including a first end, an opposite second end, a mid-longitudinal axis extending through the first end and the second end, a handle portion, a head portion, an internal cavity extending through portions of at least the handle portion and the head portion, a button portion, and an attachment/release mechanism; the handle portion extending from adjacent the first end to a first position intermediate the first end and the second end, the handle portion including an opening adjacent the first end for providing access to the internal cavity, at least one shoulder provided in the internal cavity, and a reinforcing rib provided in the internal cavity, the reinforcing rib including an aperture formed therethrough; the head portion extending from a second position intermediate the first end and the second end to the second end, the head portion including a first head portion and a second head portion being attachable to one another, the first head portion being integrally formed with the handle portion, and the second head portion being removable from the first head portion, the internal cavity extending through the first head portion, the first head portion including at least one first aperture and a second aperture formed therein, the second head portion including at least one first recess formed therein and a post formed thereon; the button portion being partially received through the opening and in the internal cavity, the button portion being moveable inwardly and outwardly with respect to the opening and the internal cavity; and the attachment/release mechanism including a connecting rod, a latch, at least one locking element, and a spring-loaded actuator, the connecting rod and the latch being unitarily formed with one another, the connecting rod and the latch being received in the internal cavity, the connecting rod extending along the mid-longitudinal axis of the toothbrush, being received through the aperture formed through the reinforcing rib, and including a first end and an opposite second end, the latch being positioned between the first end and the second end of the connecting rod, the first end of the connecting rod being operatively connected to the button portion, a locking block being provided at and adjacent the second end of the connecting rod, the connecting rod and the locking block being moveable between a first position and a second position via actuation of the button portion, the at least one locking element being at least partially received in the internal cavity, the at least one locking element being moveable inwardly and outwardly relative to the mid-longitudinal axis of the toothbrush via engagement with the locking block during movement thereof between the first position and the second position, the spring-loaded actuator being received in the internal cavity, and including a first end and an opposite second end, the first end of the spring-loaded actuator being operatively connected to the locking block, and the second end of the spring-loaded actuator being engageable to the post of the second head portion, the spring-loaded actuator being actuatable via movement of the connecting rod and the locking block between the first position and the second position; where, when the first head portion and the second head portion are attached to one another, and when the connecting rod and the locking block are in the first position, the post of the second head portion is received through the second aperture of the first head portion, and the at least one locking element is forced outwardly and received through the at least one first aperture in the first head portion and into the at least one recess in the second head portion via engagement of the locking block with the at least one locking element; where, when the button portion is actuated, and the connecting rod and the locking block are correspondingly moved from the first position to the second position, the spring-loaded actuator pushes against the post, the at least one locking element is retracted inwardly relative to the mid-longitudinal axis from the at least one recess in the second head portion to facilitate detachment of the second head portion from the first head portion, and the latch engages the at least one shoulder to hold the connecting rod in the second position; where the second head portion is replaceable with a replacement second head portion identical thereto, and, when the replacement second head portion is received on the first head portion, the contact of the post against the spring-loaded actuator causes the spring-loaded actuator to push the connecting rod and the locking block from the second position toward the first position and release the latch from the at least one shoulder.

The details of one or more aspects of the invention are set forth in the accompanying drawings and the description below. Other features, objects, and advantages of the techniques described in this disclosure will be apparent from the description and drawings, and from the claims.

DETAILED DESCRIPTION

Figure 1:
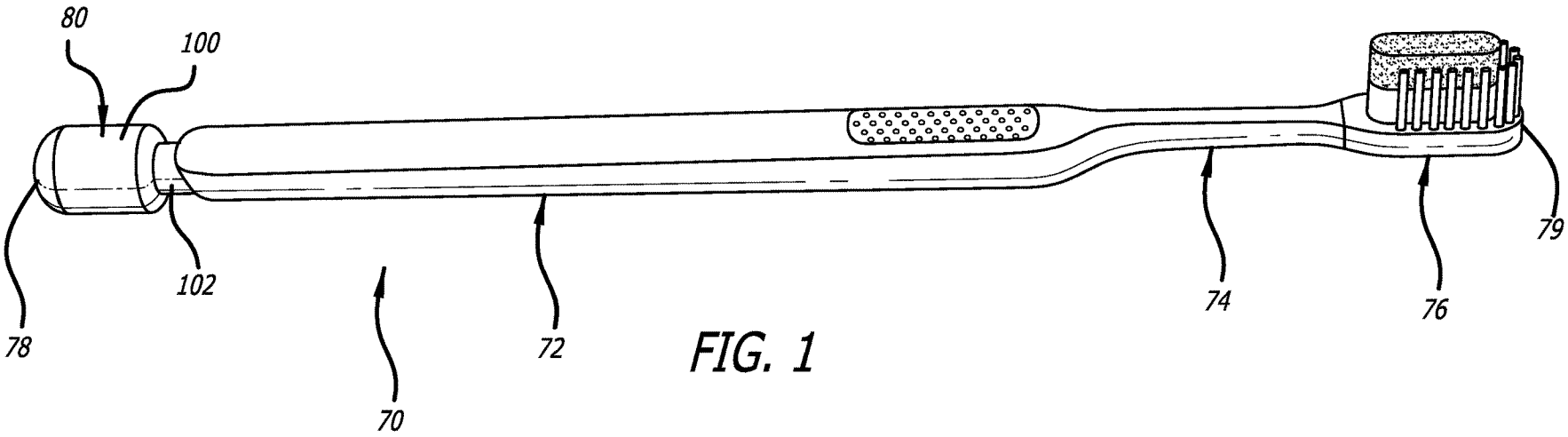
FIG. 1 is a top, side perspective view that illustrates an embodiment of a toothbrush with a detachable head portion.
Figure 2:
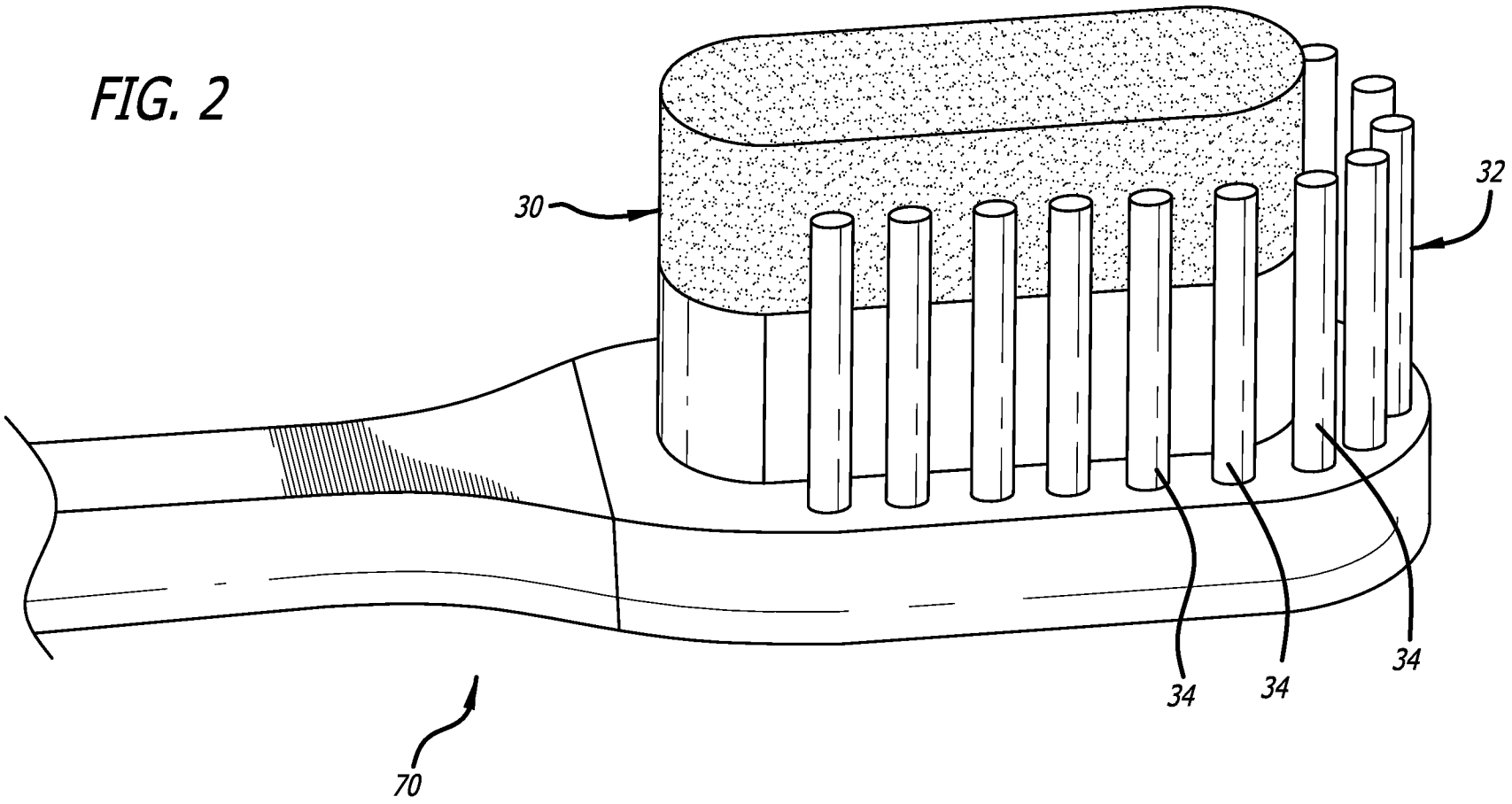
FIG. 2 is an enlarged top, side perspective view that illustrates the head portion of the toothbrush of FIG. 1.

A toothbrush according to an embodiment of the present disclosure is generally indicated by the numeral 70 in FIGS. 1-4C. The toothbrush 70 includes a handle portion 72, a neck portion 74, and a head portion 76 positioned between a first end 78 and a second end 79. As discussed below, portions of the head portion 76 are removable and replaceable. The head portion 76 of the toothbrush 70, as depicted in FIGS. 1 and 2, is removable and also includes a cleaning column 30 and a set 32 of the tufts of cleaning bristles or filaments 34. The cleaning column 30 and the set 32 of tufts of cleaning bristles 34 can be identical to that disclosed in U.S. Ser. No. 16/298,372, which is hereby incorporated by reference in its entirety. The head portion 76, and the cleaning column 30 and the set 32 of the tufts of cleaning bristles 34 used with the head portion 76 can have numerous shape configurations and arrangements. The toothbrush 70 and the head portion 76 are not limited to use of the cleaning column 30 and the set 32 of the tufts of cleaning bristles 34. Other cleaning structures such as, for example, arrangements of conventional bristles/filaments can be used with the toothbrush 70 and the head portion 76.

The head portion 76 includes a first portion 77A and a second portion 77B, and the second portion 77B is removable and replaceable with a new second portion 77B. A gasket 79 positioned between the first portion 77A and the second portion 77B can be used to facilitate creation of a seal therebetween. As discussed below, the toothbrush 70 incorporates a button portion 80 operatively connected to an attachment/release mechanism 82 for securing attachment of the second portion 77B, while also facilitating release of the second portion 77B and attachment of the new second portion 77B. The handle portion 72, the neck portion 74, and the head portion 76 can take many different forms and shapes, and FIGS. 1-4C are for illustrative purposes only.

Figure 3A:
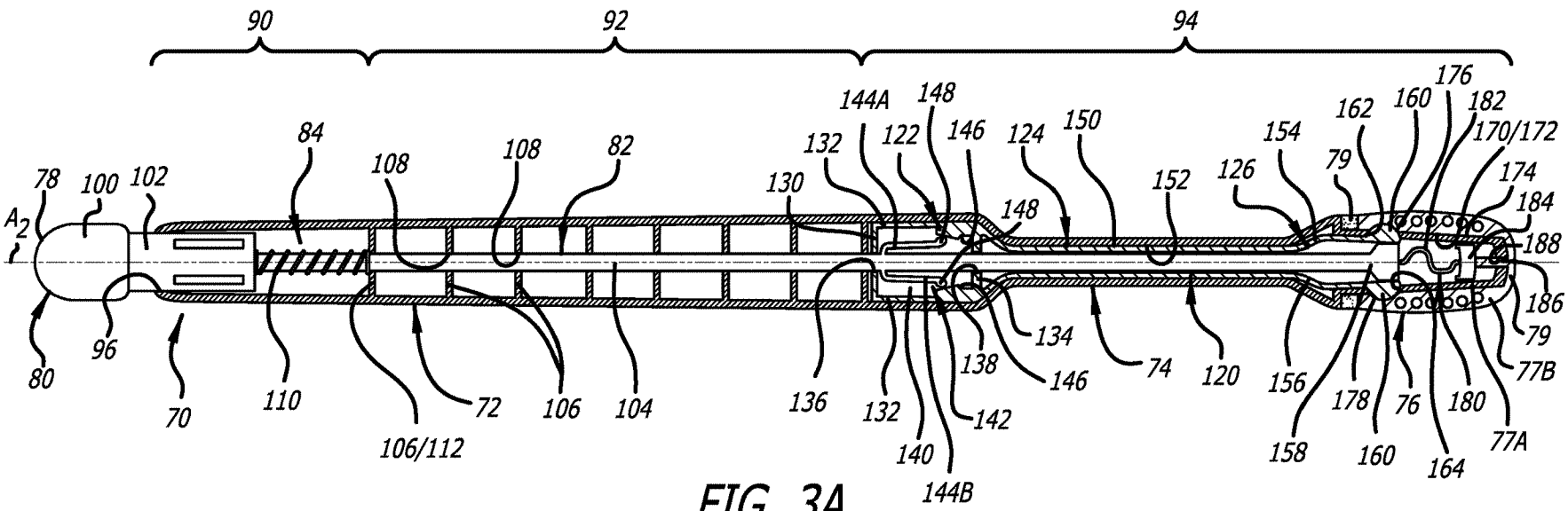
FIG. 3A is a first cross-sectional view that illustrates the toothbrush of FIG. 1 with a handle portion thereof in an undepressed first position.
Figure 3B:
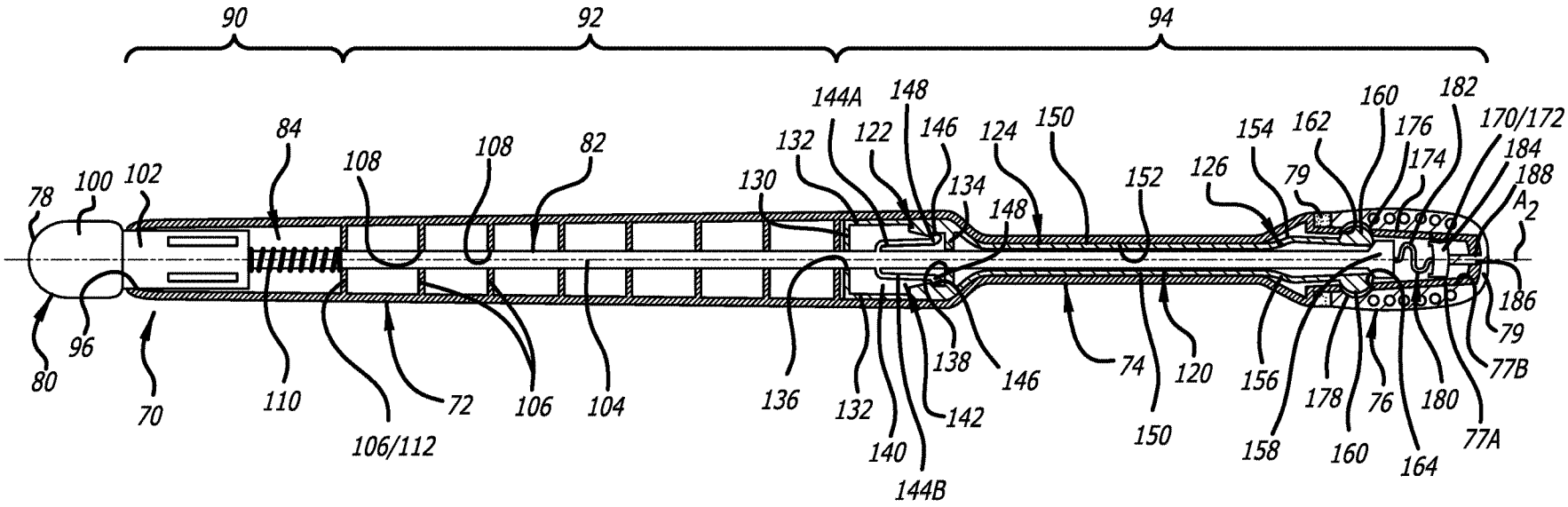
FIG. 3B is a second cross-sectional view that illustrates the toothbrush of FIG. 1 with the handle portion thereof in a depressed second position.

The handle portion 72, the neck portion 74, and the first portion 77A of the head portion 76 include an internal cavity 84 for receiving portions of the attachment/release mechanism 82. As depicted in FIGS. 3A and 3B, the internal cavity 84 includes a first portion 90, a second portion 92, and a third portion 94. The first portion 90 extends from the first end 78 toward the second end 79 within the handle portion 72, the second portion 92 extends from the first portion 90 toward the second end 79 within the handle portion 72, and the third portion 94 extends from the second portion 92 to adjacent the second end 79 within the handle portion 72, the neck portion 74, and the first portion 77A of the head portion 76.

The handle 72 includes an opening 96 affording access to the first portion 90 at the first end 78. The button portion 80 includes a first portion 100 engageable by the user of toothbrush 70, and a second portion 102 received through the opening 96 and positionable in the first portion 90 of the internal cavity 84. The second portion 102 is moveable inwardly and outwardly in a direction generally collinear with the mid-longitudinal axis A1 of the toothbrush 70. As such, the second portion 102 moves inwardly and outwardly with respect to the first portion 90 of the internal cavity 84 (via movement of the button portion 80), and, as discussed below, inward movement of the second portion 102 (via depression of the first portion 100 by the user) actuates the button portion 80 and correspondingly actuates the attachment/release mechanism 82. To illustrate, FIG. 3A depicts the button portion 80 in an undepressed first position, and FIG. 3B depicts the button portion 80 in a depressed second position. As discussed below, actuation of the button portion 80 (via movement thereof from the undepressed first position to the depressed second position) and corresponding actuation of the attachment/release mechanism 82 serves to release the second portion 77B from the first portion 77A of the head portion 76. Furthermore, returning of the button portion 80 to the undepressed first position positions portions of the attachment/release mechanism 82 to lock the second portion 77B on the first portion 77A.

Portions of the attachment/release mechanism 82 can be made of acetal or another comparable engineering plastic via a molding process. The attachment/release mechanism 82 includes a connecting rod 104 that is attached to the button portion 80. The connecting rod 104 extends from the second portion 102 of the button portion 80 through the first portion 90, the second portion 92, and the third portion 94 of the internal cavity 84, and the connecting rod 104 moves with movement of the button portion 80.

The connecting rod 104 is moveably supported within the second portion 92 of the internal cavity 84 by a plurality of reinforcing ribs 106. The reinforcing ribs 106 reinforce the handle portion 72, and each of the reinforcing ribs 106 includes an aperture 108. The apertures 108 receive the connecting rod 104 therethrough, and the reinforcing ribs 106 support the connecting rod 104 in the second portion 92 of the internal cavity 84 during movement thereof.

Via actuation of the button portion 80, the connecting rod 104 moves along an axis $A_2$ between a first position corresponding to the undepressed first position (FIG. 3A) of the button portion 80 and a second position (FIG. 3B) corresponding to the depressed second position of the button portion 80. A spring 110 can be positioned in the first portion 90 of the internal cavity 80 between the second portion 102 of the button portion 80 and a first reinforcing rib 112 of the reinforcing ribs 106, and the interaction of the spring 110 between the second portion 102 and the first reinforcing rib 112 can be used to bias the button portion 80 in the undepressed first position and correspondingly bias the connecting rod 104 in the first position.

The attachment/release mechanism 82 also includes an insert 120. The connecting rod 104 is moveably supported in the third portion 94 of the internal cavity 84 by portions of the insert 120. As depicted in FIGS. 3A and 3B, the insert 120 extends through portions of the handle portion 72, the neck portion 74, and the first portion 77A of the head portion 76. The insert 120 includes a first portion 122, a second portion 124, and a third portion 126. The first portion 122 of the insert 120 is received in the third portion 94 of internal cavity 84 that extends through a portion of the handle portion 72, the second portion 124 of the insert 120 is received in the third portion 94 of the internal cavity 84 that extends through a portion of the handle portion 72 and extends through the neck portion 74, and the third portion 126 of the insert 120 is received in the third portion 94 of the internal cavity 84 that extends through a portion of the first portion 77A of the head portion 76.

The first portion 122 of the insert 120 includes an end wall 130, sidewalls 132, and a reinforcing rib 134. The end wall 130 includes an aperture 136 therethrough, and the reinforcing rib 134 includes an aperture 138 therethrough. As depicted in FIGS. 3A and 3B, the apertures 136 and 138 receive the connecting rod 104 therethrough, and the end wall 130 and the reinforcing rib 134 support movement of the connecting rod 104 in a cavity 140 of the insert 120 formed in the confines of the end wall 130, sidewalls 132, and the reinforcing rib 134.

The connecting rod 104 includes a wishbone-shaped latch 142 including a first arm 144A and a second arm 144B for engaging shoulders 146 formed on the sidewalls 132 in the cavity 140. When the connecting rod 104 is moved from the first position (FIG. 3A) to the second position (FIG. 3B) via actuation of the button portion 80, catches 148 formed on each of the first arm portion 144A and the second arm portion 144B are forced into engagement with the shoulders 146. The first arm portion 144A and the second arm portion 144B are flexible inwardly and outwardly with respect to the axis $A_2$ of the connecting rod 104 to facilitate such engagement, and the engagement of the catches 148 with the shoulders 146 serves in holding the connecting rod in the second position. As discussed below, the catches 148 of the first arm portion 144A and the second arm portion 144B are forced to disengage from the shoulders 146 via movement of the connecting rod 104 from the second position to the first position.

The second portion 124 of the insert 120 shares the reinforcing rib 134 with the first portion 122 and includes sidewalls 150. As depicted in FIGS. 3A and 3B, the sidewalls 150 moveably support the connecting rod 104 in a second cavity 152 formed in the confines of the reinforcing rib 134 and the sidewalls 150. As such, a majority the sidewalls 150 along the lengths thereof serve as a bushing for moveably supporting the connecting rod 104.

As depicted in FIGS. 3A-4C, the third portion 126 of the insert 120 includes a first locking element 154 and a second locking element 156. The first locking element 154 and the second locking element 156 extend into the third portion 94 of the internal cavity 84 that extends through a portion of the first portion 77A. The connecting rod 104 is positioned between the first locking element 154 and the second locking element 156, and the connecting rod 104 includes a locking block 158 formed thereon.

The first locking element 154 and the second locking element 156 are flexible inwardly and outwardly with respect to the axis $A_2$ of the connecting rod 104, and such inward and outward movement is controlled by the position of the locking block 158. The locking block 158 moves with movement of the connecting rod 104 between the first position and the second position.

When the connecting rod 104 is the first position (FIGS. 3A and 4A), the locking block 158 forces outward movement of the first locking element 154 and the second locking element 156 with respect to the axis $A_2$. And when the connecting rod 104 is in the second position (FIGS. 3B and 4B), the locking block 158 affords inward movement of the first locking element 154 and the second locking element 156 with respect to the axis $A_2$. Catches 160 are formed on each of the first locking element 154 and the second locking element 156. If the connecting rod 104 is in the first position (FIGS. 3A and 4A), the catches 160 of the first locking element 154 and the second locking element 156 are forced through a first aperture 162 and a second aperture 164, respectively, formed in the first portion 77A of the head portion 76.

Figure 4A:
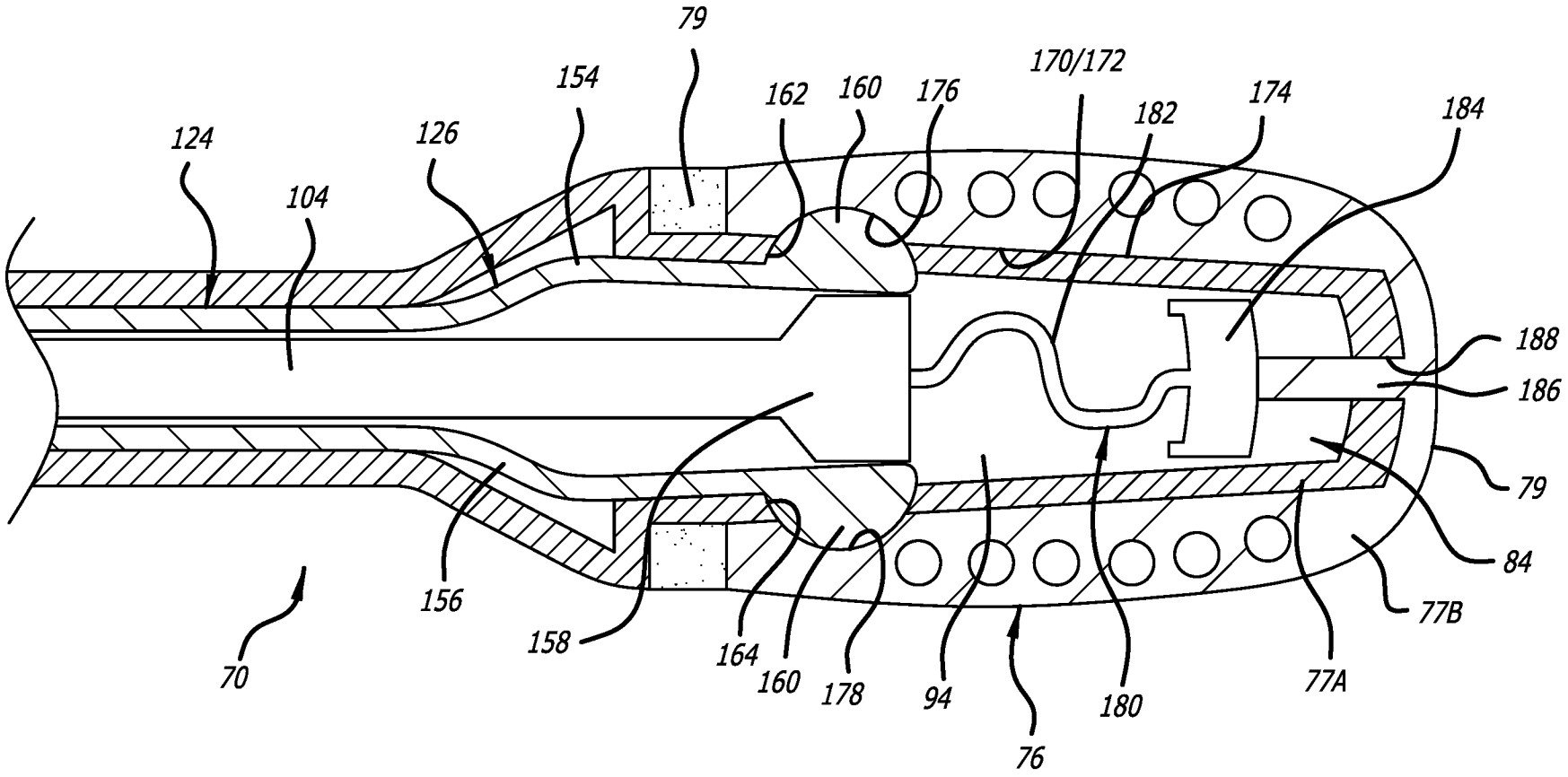
FIG. 4A is an enlarged portion of the first cross-sectional view of FIG. 3A that illustrates a first embodiment of a spring-loaded actuator in a first position.
Figure 4B:
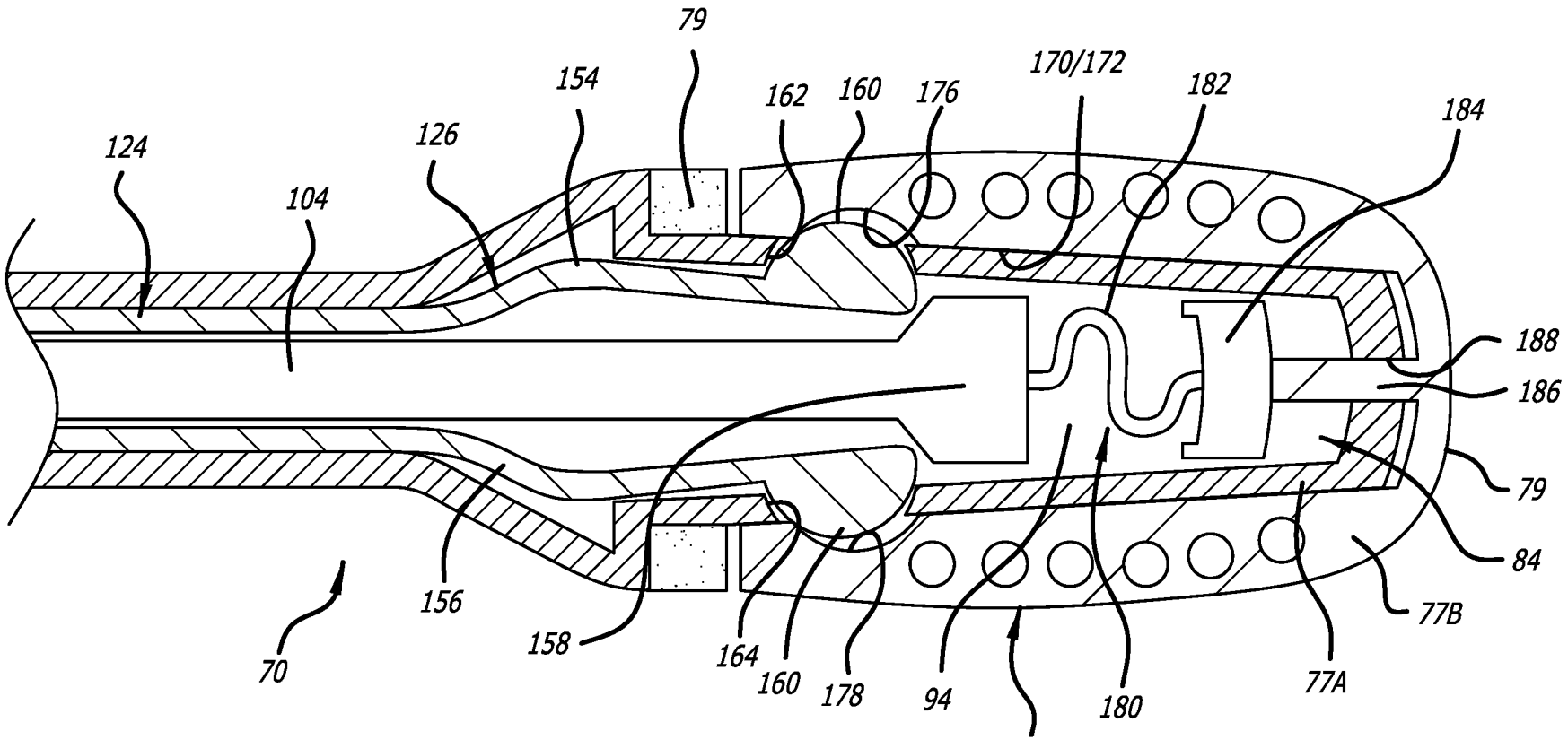
FIG. 4B is an enlarged portion of the second cross-sectional view of FIG. 3B that illustrates the first embodiment of the spring-loaded actuator in a second position.
Figure 4C:
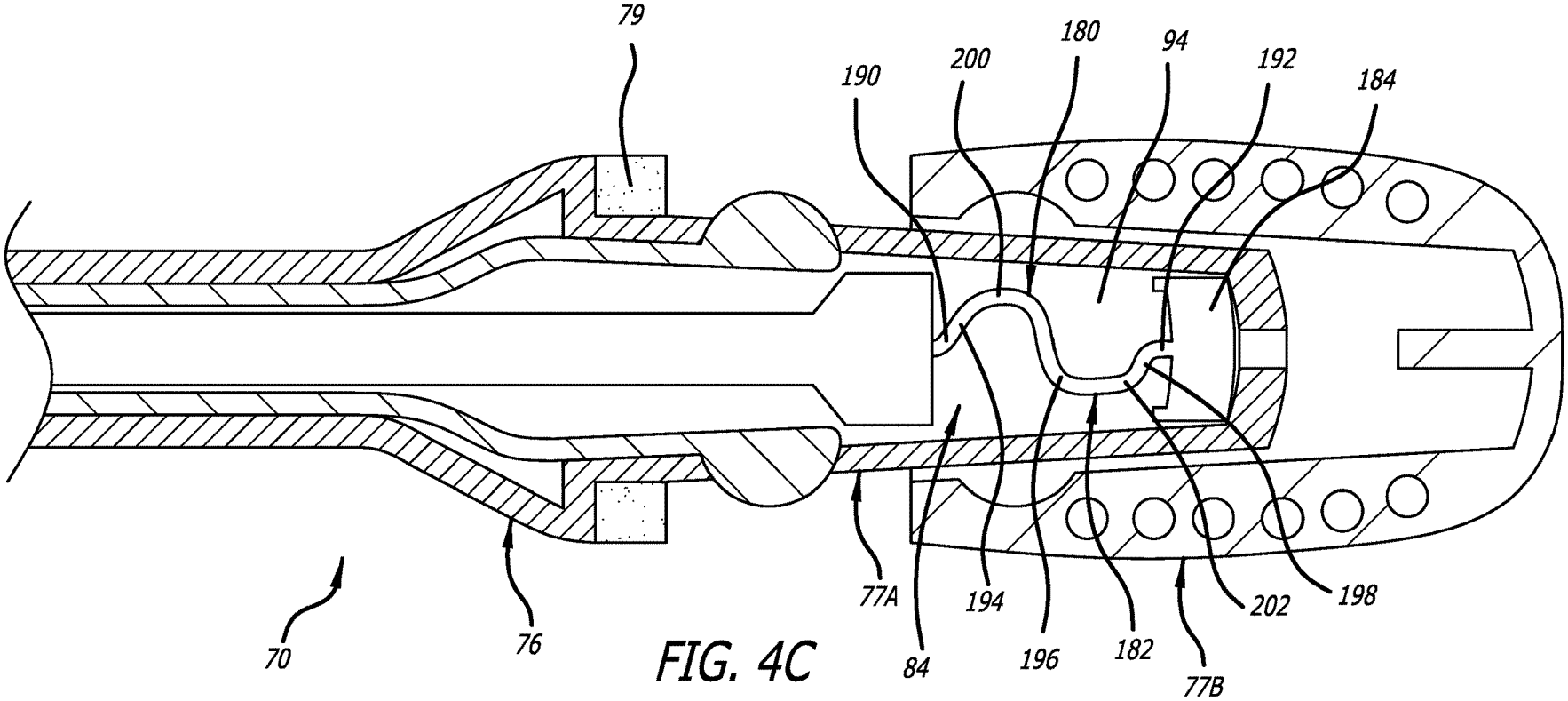
FIG. 4C is an enlarged third cross-sectional view that illustrates the toothbrush of FIG. 1 with a portion of the head portion thereof removed.

The second portion 77B of the head portion 76 includes an interior 170 having an interior surface 172. The interior 170 is sized to receive the first portion 77A of the head portion 76 therein, and the interior surface 172 is shaped to compliment an exterior surface 174 of the first portion 77A of the head portion 76. The interior surface 172 includes a first recess 176 and a second recess 178 formed therein that are sized to receive portions of the catches 160 of the first locking element 154 and the second locking element 156, respectively. Thus, when the first portion 77A of the head portion 76 is inserted into the interior 170, and if the connecting rod 104 is in the second position, the first locking element 154 and the second locking element 156 can flex inward to afford movement of the interior surface 172 with respect to the exterior surface 174 until the catches 160 of the first locking element 154 and the second locking element 156 are received in the first recess 176 and the second recess 178, respectively. Thereafter, movement of the connecting rod 104 from the second position to the first position (via movement of the button portion 80 from the depressed second position to the undepressed first position) serves to lock the second portion 77B on the first position 77A by maintaining the position of the catches 160 in the first recess 176 and the second recess 178 by preventing inward movement of the first locking element 154 and the second locking element 156 with the locking block 158. The second portion 77B can be unlocked (and then removed) from the first portion 77A by moving of the connecting rod 104 from the first portion to the second position (via movement of the button portion 80 from the undepressed first position to the depressed second position) so that the locking block 158 is positioned to afford inward movement of the first locking element 154 and the second locking element 156, and hence, permit removal of the catches 160 from the first recess 176 and the second recess 178. Thus, as depicted in FIG. 4C, the second portion 77B can be removed from the first portion 77A with the connecting rod 104 in the second position.

To aid the removal of the second portion 77B from the first portion 77A, the attachment/release mechanism 82 also includes a spring-loaded actuator 180 attached to the locking block 158 for engaging the second portion 77B. All or portions of the spring-loaded actuator 180 can be unitarily formed with the connecting rod 104 and the locking block 158. The spring-loaded actuator 180 includes a spring 182 and an initiating block 184, and the second portion 77B includes a post 186 that is received through an aperture 188 when the second portion 77B is received on the first portion 77A. The spring 182 is attached to the locking block 158, and, whether the connecting rod 104 is in the first position or the second position, the spring 182 is used to force the initiating block 184 against the post 186. The force applied by the spring 182 to the post 186 via the initiating block 184 is sufficient to push the second portion 77B off of the first portion 77A when the connecting rod 104 is in the second position.

The force applied by the spring 182 also works in reverse to move the connecting rod 104 from the second position to the first position when a new second portion 77B is attached to the first portion 77A. During attachment of the new second portion 77B by reversing the process depicted in FIGS. 3A-4C, the post 186 from the new second portion 77B pushes against the initiating block 184, and the spring 182 correspondingly pushes against the locking 158 to force the connecting rod 104 from the second position to the first position. The force applied by the spring 182 working in reverse during attachment of the new second portion 77B to the first portion 77A is aided by the force applied the spring 110, and the movement of the connecting rod 104 caused by such forces are sufficient to disengage the catches 148 of the first arm portion 144A and the second arm portion 144B from the shoulders 146. As such, attachment of the new second portion 77B to the first portion 77A serves in move the connecting rod 104 from the second position to the first position, and thus, move the button portion 80 from the depressed second position to the undepressed first position.

As depicted in FIGS. 3A-4C, the toothbrush 70 operates as follows with respect to the first portion 77A and the second portion 77B of the head portion 76. Assuming the second portion 77B is locked on the first portion 77A (FIGS. 3A and 4A), the button portion 80 will be in the undepressed first position and the connecting rod 104 will be in the first position. With the connecting rod 104 being in the first position, the locking block 158 is positioned by the connecting rod 104 to prevent inward movement of the first locking element 154 and the second locking element 156, and thus, maintain position of the catches in the first recess 176 and the second recess 178. Actuation of the button portion 80 from the undepressed first position to the depressed second position actuates the connecting rod 104 to move from the first position to the second position. When the connecting rod 104 is in the second position, the locking block 158 is positioned to afford inward movement of the first locking element 154 and the second locking element 156, and hence, removal of the catches 160 from the first recess 176 and the second recess 178. As such, actuation of the button portion 80 and corresponding actuation of the attachment/release mechanism 82 unlocks the second portion 77B from the first portion 77A. The second portion 77B can then be removed from the first portion 77A. Furthermore, the spring 182 is used to force the initiating block 184 against the post 186 to aid the removal of the second portion 77B from the first portion 77A.

The connecting rod 104 is held in the second position after actuation of the button portion by the engagement of the catches 148 of the first arm portion 144A and the second arm portion 144B with the shoulders 146. When a new second portion 77B is attached to the first portion 77A by reversing the process depicted in FIGS. 3A-4C, the force applied by the spring 182 works in reverse to move the connecting rod 104 from the second position to the first position. The attachment of the new second portion 77B causes the post 186 from the new second portion 77B to push against the initiating block 184, and the spring 182 correspondingly pushes against the locking 158 to force the connecting rod 104 from the second position to the first position. The force applied by the spring 182 working in reverse during attachment of the new second portion 77B to the first portion 77A is aided by the force applied the spring 110. The movement of the connecting rod 104 caused by such forces are sufficient to disengage the catches 148 of the first arm portion 144A and the second arm portion 144B from the shoulders 146. Thus, attachment of the new second portion 77B to the first portion 77A serves in moving the connecting rod 104 from the second position to the first position and correspondingly moving the button portion 80 from the depressed second position to the undepressed first position. With the button portion 80 in the first position and the connecting rod 104 correspondingly in the undepressed first position, the new second portion 77B is locked on the first portion 77A.

As discussed above, the spring 182 is used to aid the removal of the second portion 77B from the first portion 77A, and used in reverse to move the connecting rod 104 from the second position to the first position. The configuration of the spring 182 facilitates such action. The spring 182 is a type of flat or leaf spring, and, as depicted in FIG. 4C, includes a first end portion 190 attached to the locking block 158, a second end 192 attached to the initiating block 184, a first link portion 194, a second link portion 196, a third link portion 198, a first connecting portion 200, and a second connecting portion 202. The first link portion 194 and the second link portion 196 are joined to one another by the first connecting portion 200, and the second link portion 196 and the third link portion 198 are joined to one another by the second connecting portion 202. The spring action between the first link portion 194 and the second link portion 196 by the first connecting portion 200, and the spring action between the second link portion 196 and the third link portion 198 by the second connecting portion 202 provides the force necessary for operation of the spring-loaded actuator 180.

Figure 5:
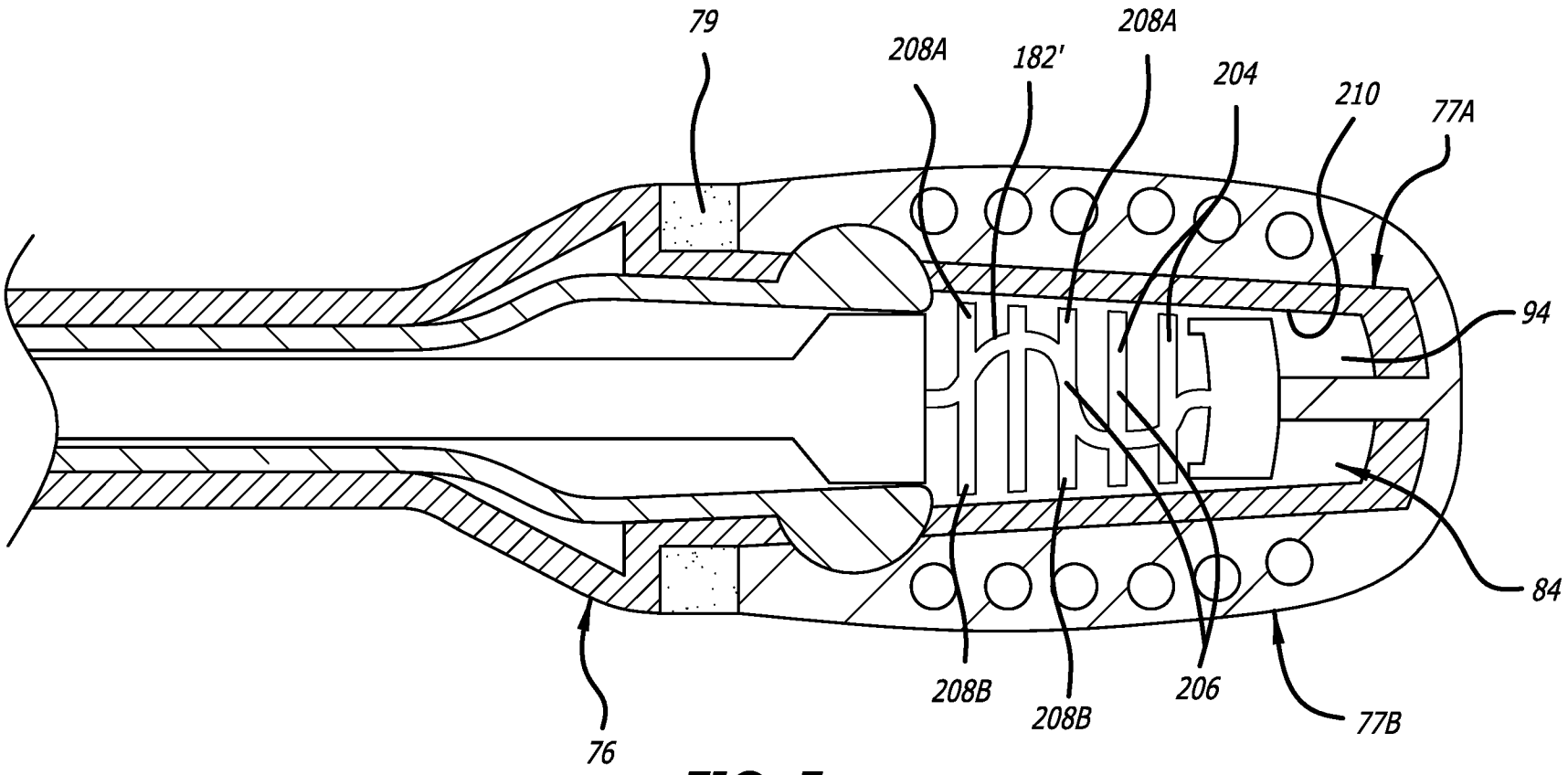
FIG. 5 is an enlarged cross-sectional view of the toothbrush of FIG. 1 that illustrates a modified spring incorporated therein.

As depicted in FIG. 5, the spring 182 of the spring-loaded actuator 180 can be modified to be spring 182' that includes various guides 204 spaced therealong. Like the spring-loaded actuator 180, the spring 182, and other portions of the attachment/release mechanism 82, the spring 182' can be made of acetal or another comparable engineering plastic via a molding process. Each of the guides 204 include an inner portion 206, a first end portion 208A, and a second end portion 208B. The inner portion 206 of each of the guides 204 is connected to the remainder of the spring 182'. Furthermore, the third portion 94 of the internal cavity 94 includes an inner surface 210, and the first end portion 208A and the second end portion 208B of the spring 182' can be used to contact the inner surface 210 to keep the spring 182' properly oriented in the third portion 94.

Figure 6:
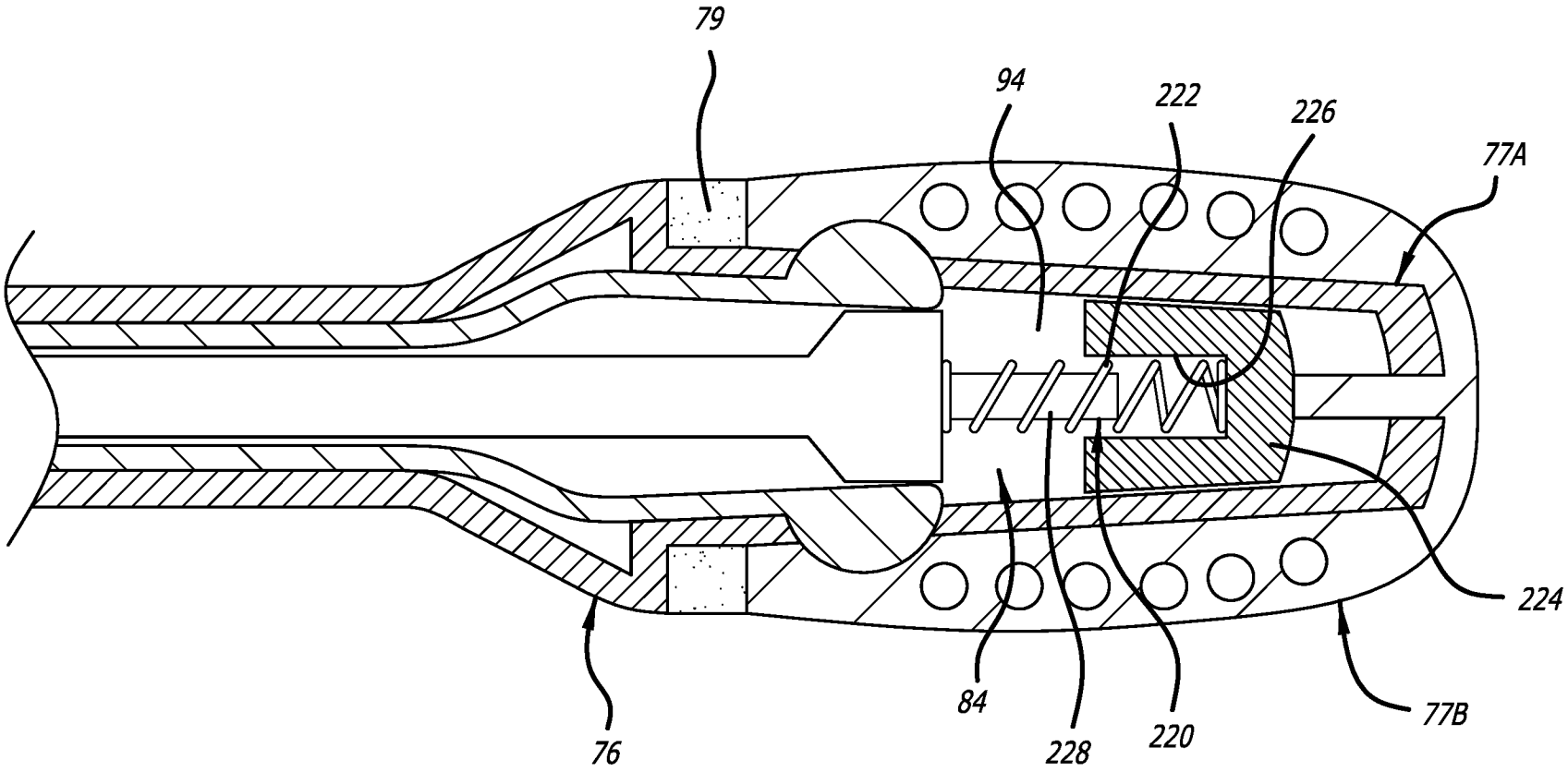
FIG. 6 is an enlarged cross-sectional view of the toothbrush of FIG. 1 that illustrates a second embodiment of a spring-loaded actuator.

As depicted in FIG. 6, a spring-loaded actuator 220 can be used instead of the spring-loaded actuator 180. Like the spring-loaded actuator 180 and other portions of the attachment/release mechanism 82, portions of the spring-loaded actuator 220 can be made of acetal or another comparable engineering plastic via a molding process. The spring-loaded actuator 220 includes a spring 222 that is a coil spring, and an initiating block 224 including an aperture 226 for receiving the spring 222 there. Furthermore, the locking block 158 can be modified to be a locking block 158' that includes a post 22 for receiving the spring 220 thereon. The spring-loaded actuator 220 operates in similar fashion to the spring-loaded actuator 180.

In one embodiment, the connecting rod 104 (including the wishbone-shaped latch 142), the locking block 158, the spring 182 (or the spring 182'), and/or the initiating block 184 can be unitarily molded with one another.

It should be understood that various aspects disclosed herein may be combined in different combinations than the combinations specifically presented in the description and the accompanying drawings. It should also be understood that, depending on the example, certain acts or events of any of the processes or methods described herein may be performed in a different sequence, may be added, merged, or left out altogether (e.g., all described acts or events may not be necessary to carry out the techniques). In addition, while certain aspects of this disclosure are described as being performed by a single module or unit for purposes of clarity, it should be understood that the techniques of this disclosure may be performed by a combination of units or modules.

I claim:

1. A toothbrush comprising:

a first end, an opposite second end, a mid-longitudinal axis extending through the first end and the second end, a handle portion, a head portion, an internal cavity extending through portions of at least the handle portion and the head portion, a button portion, and an attachment/release mechanism;

the handle portion extending from adjacent the first end to a first position intermediate the first end and the second end, the handle portion including an opening adjacent the first end for providing access to the internal cavity;

the head portion extending from a second position intermediate the first end and the second end to the second end, the head portion including a first head portion and a second head portion being attachable to one another, the first head portion being integrally formed with the handle portion, and the second head portion being removable from the first head portion, the internal cavity extending through the first head portion, the first head portion including at least one first aperture and a second aperture formed therein, the second head portion including at least one first recess formed therein and a post formed thereon;

the button portion being partially received through the opening and in the internal cavity, the button portion being moveable inwardly and outwardly with respect to the opening and the internal cavity; and the attachment/release mechanism including a connecting rod, at least one locking element, and a spring-loaded actuator, the connecting rod being received in the internal cavity, and extending along the mid-longitudinal axis of the toothbrush, and including a first end and an opposite second end, the first end of the connecting rod being operatively connected to the button portion, a locking block being provided at and adjacent the second end of the connecting rod, the connecting rod and the locking block being moveable between a first position and a second position via actuation of the button portion, the at least one locking element being at least partially received in the internal cavity, the at least one locking element being moveable inwardly and outwardly relative to the mid-longitudinal axis of the toothbrush via engagement of the locking block during movement thereof between the first position and the second position, the spring-loaded actuator being received in the internal cavity, and including a first end and an opposite second end, the first end of the spring-loaded actuator being operatively connected to the locking block, and the second end of the spring-loaded actuator being engageable to the post of the second head portion, the spring-loaded actuator being actuatable via movement of the connecting rod and the locking block between the first position and the second position;

wherein, when the first head portion and the second head portion are attached to one another, and when the connecting rod and the locking block are in the first position, the post of the second head portion is received through the second aperture of the first head portion, and the at least one locking element is forced outwardly and received through the at least one first aperture in the first head portion and into the at least one recess in the second head portion via engagement of the locking block with the at least one locking element; and wherein, when the button portion is actuated, and the connecting rod and the locking block are correspondingly moved from the first position to the second position, the spring-loaded actuator pushes against the post, and the at least one locking element is retracted inwardly relative to the mid-longitudinal axis from the at least one recess in the second head portion to facilitate detachment of the second head portion from the first head portion.

2. The toothbrush of claim 1, further comprising a latch unitarily formed with the connecting rod, and the handle portion including at least one shoulder in the internal cavity, wherein, when the connecting rod is moved from the first position to the second position, the latch engages the at least one shoulder to hold the connecting rod in the second position.

3. The toothbrush of claim 2, wherein the second head portion is replaceable with a replacement second head portion identical thereto, and, when the replacement second head portion is received on the first head portion, the contact of the post against the spring-loaded actuator causes the spring-loaded actuator to push the connecting rod and the locking block from the second position toward the first position and release the latch from the at least one shoulder.

4. The toothbrush of claim 1, wherein the spring-loaded actuator includes a spring and an initiating block, the spring including a first end and an opposite second end, the first end of the spring being operatively connected to the locking block, and the second end of the spring being operatively connected to the initiating block, and wherein, movement of the connecting rod and the locking block from the first position toward the second position causes an increase in spring force applied to the post of the second head portion facilitating detachment of the second head portion from the first head portion.

5. The toothbrush of claim 1, wherein the at least one locking element is biased inwardly toward the mid-longitudinal axis, and when the button portion is actuated, and the connecting rod and the locking block are correspondingly moved from the first position to the second position, the at least locking element retracts inwardly due to decreased contact with the locking block.

6. The toothbrush of claim 5, wherein the attachment/release mechanism includes a first one and a second one of the at least one locking element positioned adjacent opposed portions of the connecting rod and the locking block, a first one and a second one of the at least a first aperture provided in opposed portions of the first head portion, and a first one and a second one of the at least a first recess provided in opposed portions of the second head portion, each of the first one and the second one of the locking element being biased inwardly toward the mid-longitudinal axis.

7. The toothbrush of claim 6, wherein, when the connecting rod and the locking block are in the first position, the first one of the at least one locking element is received through the first one of the at least a first aperture and in the first one of the at least a first recess, and the second one of the at least one locking element is received through the second one of the at least a first aperture and in the second one of the at least a first recess.

8. The toothbrush of claim 1, further comprising a reinforcing rib provided in the internal cavity of the toothbrush, the reinforcing rib including an aperture therethrough for receiving the connecting rod therein, the reinforcing rib supporting movement of the connecting rod between the first position and the second position thereof.

9. The toothbrush of claim 8, further comprising a spring positioned in the internal cavity between the button portion and the reinforcing rib, the spring biasing the button portion in an unactuated position.

10. A toothbrush comprising:

a first end, an opposite second end, a mid-longitudinal axis extending through the first end and the second end, a handle portion, a head portion, an internal cavity extending through portions of at least the handle portion and the head portion, a button portion, and an attachment/release mechanism;

the handle portion extending from adjacent the first end to a first position intermediate the first end and the second end, the handle portion including an opening adjacent the first end for providing access to the internal cavity, and at least one shoulder in the internal cavity;

the head portion extending from a second position intermediate the first end and the second end to the second end, the head portion including a first head portion and a second head portion being attachable to one another, the first head portion being integrally formed with the handle portion, and the second head portion being removable from the first head portion, the internal cavity extending through the first head portion, the first head portion including at least one first aperture and a second aperture formed therein, the second head portion including at least one first recess formed therein and a post formed thereon;

the button portion being partially received through the opening and in the internal cavity, the button portion being moveable inwardly and outwardly with respect to the opening and the internal cavity; and the attachment/release mechanism including a connecting rod, a latch, at least one locking element, and a spring-loaded actuator, the connecting rod and the latch being unitarily formed with one another, the connecting rod and the latch being received in the internal cavity, the connecting rod extending along the mid-longitudinal axis of the toothbrush, and including a first end and an opposite second end, the latch being positioned between the first end and the second end of the connecting rod, the first end of the connecting rod being operatively connected to the button portion, a locking block being provided at and adjacent the second end of the connecting rod, the connecting rod and the locking block being moveable between a first position and a second position via actuation of the button portion, the at least one locking element being at least partially received in the internal cavity, the at least one locking element being moveable inwardly and outwardly relative to the mid-longitudinal axis of the toothbrush via engagement with the locking block during movement thereof between the first position and the second position, the spring-loaded actuator being received in the internal cavity, and including a first end and an opposite second end, the first end of the spring-loaded actuator being operatively connected to the locking block, and the second end of the spring-loaded actuator being engageable to the post of the second head portion, the spring-loaded actuator being actuatable via movement of the connecting rod and the locking block between the first position and the second position;

wherein, when the first head portion and the second head portion are attached to one another, and when the connecting rod and the locking block are in the first position, the post of the second head portion is received through the second aperture of the first head portion, and the at least one locking element is forced outwardly and received through the at least one first aperture in the first head portion and into the at least one recess in the second head portion via engagement of the locking block with the at least one locking element; and wherein, when the button portion is actuated, and the connecting rod and the locking block are correspondingly moved from the first position to the second position, the spring-loaded actuator pushes against the post, the at least one locking element is retracted inwardly relative to the mid-longitudinal axis from the at least one recess in the second head portion to facilitate detachment of the second head portion from the first head portion, and the latch engages the at least one shoulder to hold the connecting rod in the second position.

11. The toothbrush of claim 10, wherein the second head portion is replaceable with a replacement second head portion identical thereto, and, when the replacement second head portion is received on the first head portion, the contact of the post against the spring-loaded actuator causes the spring-loaded actuator to push the connecting rod and the locking block from the second position toward the first position and release the latch from the at least one shoulder.

12. The toothbrush of claim 11, wherein the spring-loaded actuator includes a spring and an initiating block, the spring including a first end and an opposite second end, the first end of the spring being operatively connected to the locking block, and the second end of the spring being operatively connected to the initiating block, and wherein, movement of the connecting rod and the locking block from the first position toward the second position causes an increase in spring force applied to the post of the second head portion facilitating detachment of the second head portion from the first head portion.

13. The toothbrush of claim 12, wherein the at least one locking element is biased inwardly toward the mid-longitudinal axis, and when the button portion is actuated, and the connecting rod and the locking block are correspondingly moved from the first position to the second position, the at least locking element retracts inwardly due to decreased contact with the locking block.

14. The toothbrush of claim 13, wherein the attachment/release mechanism includes a first one and a second one of the at least one locking element positioned adjacent opposed portions of the connecting rod and the locking block, a first one and a second one of the at least a first aperture provided in opposed portions of the first head portion, and a first one and a second one of the at least a first recess provided in opposed portions of the second head portion, each of the first one and the second one of the locking element being biased inwardly toward the mid-longitudinal axis.

15. The toothbrush of claim 14, wherein, when the connecting rod and the locking block are in the first position, the first one of the at least one locking element is received through the first one of the at least a first aperture and in the first one of the at least a first recess, and the second one of the at least one locking element is received through the second one of the at least a first aperture and in the second one of the at least a first recess.

16. The toothbrush of claim 10, further comprising a reinforcing rib provided in the internal cavity of the toothbrush, the reinforcing rib including an aperture therethrough for receiving the connecting rod therein, the reinforcing rib supporting movement of the connecting rod between the first position and the second position thereof.

17. The toothbrush of claim 16, further comprising a spring positioned in the internal cavity between the button portion and the reinforcing rib, the spring biasing the button portion in an unactuated position.

18. A toothbrush comprising:

a first end, an opposite second end, a mid-longitudinal axis extending through the first end and the second end, a handle portion, a head portion, an internal cavity extending through portions of at least the handle portion and the head portion, a button portion, and an attachment/release mechanism;

the handle portion extending from adjacent the first end to a first position intermediate the first end and the second end, the handle portion including an opening adjacent the first end for providing access to the internal cavity, at least one shoulder provided in the internal cavity, and a reinforcing rib provided in the internal cavity, the reinforcing rib including an aperture formed therethrough;

the head portion extending from a second position intermediate the first end and the second end to the second end, the head portion including a first head portion and a second head portion being attachable to one another, the first head portion being integrally formed with the handle portion, and the second head portion being removable from the first head portion, the internal cavity extending through the first head portion, the first head portion including at least one first aperture and a second aperture formed therein, the second head portion including at least one first recess formed therein and a post formed thereon;

the button portion being partially received through the opening and in the internal cavity, the button portion being moveable inwardly and outwardly with respect to the opening and the internal cavity; and the attachment/release mechanism including a connecting rod, a latch, at least one locking element, and a spring-loaded actuator, the connecting rod and the latch being unitarily formed with one another, the connecting rod and the latch being received in the internal cavity, the connecting rod extending along the mid-longitudinal axis of the toothbrush, being received through the aperture formed through the reinforcing rib, and including a first end and an opposite second end, the latch being positioned between the first end and the second end of the connecting rod, the first end of the connecting rod being operatively connected to the button portion, a locking block being provided at and adjacent the second end of the connecting rod, the connecting rod and the locking block being moveable between a first position and a second position via actuation of the button portion, the at least one locking element being at least partially received in the internal cavity, the at least one locking element being moveable inwardly and outwardly relative to the mid-longitudinal axis of the toothbrush via engagement with the locking block during movement thereof between the first position and the second position, the spring-loaded actuator being received in the internal cavity, and including a first end and an opposite second end, the first end of the spring-loaded actuator being operatively connected to the locking block, and the second end of the spring-loaded actuator being engageable to the post of the second head portion, the spring-loaded actuator being actuatable via movement of the connecting rod and the locking block between the first position and the second position;

wherein, when the first head portion and the second head portion are attached to one another, and when the connecting rod and the locking block are in the first position, the post of the second head portion is received through the second aperture of the first head portion, and the at least one locking element is forced outwardly and received through the at least one first aperture in the first head portion and into the at least one recess in the second head portion via engagement of the locking block with the at least one locking element;

wherein, when the button portion is actuated, and the connecting rod and the locking block are correspondingly moved from the first position to the second position, the spring-loaded actuator pushes against the post, the at least one locking element is retracted inwardly relative to the mid-longitudinal axis from the at least one recess in the second head portion to facilitate detachment of the second head portion from the first head portion, and the latch engages the at least one shoulder to hold the connecting rod in the second position; and wherein the second head portion is replaceable with a replacement second head portion identical thereto, and, when the replacement second head portion is received on the first head portion, the contact of the post against the spring-loaded actuator causes the spring-loaded actuator to push the connecting rod and the locking block from the second position toward the first position and release the latch from the at least one shoulder.

19. The toothbrush of claim 18, wherein the spring-loaded actuator includes a spring and an initiating block, the spring including a first end and an opposite second end, the first end of the spring being operatively connected to the locking block, and the second end of the spring being operatively connected to the initiating block, and wherein, movement of the connecting rod and the locking block from the first position toward the second position causes an increase in spring force applied to the post of the second head portion facilitating detachment of the second head portion from the first head portion.

20. The toothbrush of claim 19, wherein the at least one locking element is biased inwardly toward the mid-longitudinal axis, and when the button portion is actuated, and the connecting rod and the locking block are correspondingly moved from the first position to the second position, the at least locking element retracts inwardly due to decreased contact with the locking block.

* * * * *